United States Patent [19]

Shibaike et al.

[11] Patent Number: 5,072,241

[45] Date of Patent: Dec. 10, 1991

[54] INK RECORDING APPARATUS PROVIDED WITH SHUTTER

[75] Inventors: Narito Shibaike, Hirakata; Soichiro Mima, Nishinomiya, both of Japan

[73] Assignee: Matsushita Electric Industrial Co., Ltd., Osaka, Japan

[21] Appl. No.: 579,325

[22] Filed: Sep. 10, 1990

[30] Foreign Application Priority Data

Sep. 11, 1989 [JP] Japan ..... 1-235053

[51] Int. Cl.[5] ..... B41J 2/07

[52] U.S. Cl. ..... 346/140 R

[58] Field of Search ..... 346/140 R

[56] References Cited

U.S. PATENT DOCUMENTS 4,199,767 4/1980 Campbell et al. ..... 346/140 R 4,458,255 7/1984 Giles ..... 346/140 R

FOREIGN PATENT DOCUMENTS 0156969 7/1987 Japan ..... 346/140 R

*Primary Examiner*—Benjamin R. Fuller

*Assistant Examiner*—Alrick Bobb

*Attorney, Agent, or Firm*—Wenderoth, Lind & Ponack

[57] ABSTRACT

An ink recording apparatus used with printers or the like and manufactured by applying semiconductor device manufacturing techniques. One wall of an ink chamber is formed of a single-crystal substrate and an ink jet port is formed by etching on the single-crystal substrate. A shutter and electrodes composed of polycrystalline-silicon film are formed on the single-crystal substrate by film forming in the LPCVD method and patterning through plasma etching. A front wall is formed by coating the shutter and electrodes further with a polycrystalline-silicon film. The shutter is movable between the wall surface of the ink chamber and the front wall, being driven through electrostatic attracting force produced between voltage-applied electrodes and the shutter. The electrodes are formed at positions corresponding to those where the shutter blocks the ink jet port and releases the same.

3 Claims, 17 Drawing Sheets

INK RECORDING APPARATUS PROVIDED WITH SHUTTER

BACKGROUND OF THE INVENTION

1. Field of the invention

The present invention relates to an ink recording apparatus for use in printers or the like. It is to be noted that the word 'recording' herein used refers to the fact that any desired patterns of characters, symbols, or the like are written down onto a printed material such as paper with ink jetted out by an apparatus of the present invention.

2. Description of the Related Art

A conventional ink recording apparatus is shown in the Japanese magazine "Nikkei Mechanical", issued on May 29, 1989, pp. 90 to 91, the apparatus exemplifying such ink recording apparatus that are currently used in printers featuring compactness suitable for office or personal use thereof.

FIG. 10 shows a construction of such a conventional ink recording apparatus. In the figure, a slit plate 1 is provided with a plurality of slits 2 having a width of 50 μm and a length of 8 mm in place of nozzles. The slit plate 1 has also a plurality of auxiliary holes 3 equal in number to a plurality of heating elements 5 formed on a base plate 4, with an ink reservoir 6 as well provided on the slit plate. On the base plate 4 there are formed a plurality of electrodes 7 in correspondence to the heating elements 5 and moreover a plurality of fluid resistance elements 8 shaped into a long, narrow protrusion. Besides, between the slit plate 1 and the base plate 4 there is disposed a spacer 9, which in conjunction with the slit plate 1 and base plate 4 defines a portion serving as an ink chamber 11 illustrated in FIGS. 11*a* to 11*d*. Under the base plate 4 there is provided an ink tank 10, whereon all the units are piled up to make up a head. The heating elements 5 are formed by piling up a glass layer, resistors, electrodes, and a protective coat on the base plate 4, as in a common thermal head.

A conventional ink recording apparatus having a construction as described above will jet ink droplets while carrying out steps as shown in FIGS. 11*a* to 11*d*. Each step is detailed below:

(a) First, when pulse voltage is applied to the heating elements 5 on the base plate 4 to heat the ink contained in the ink chamber 11, the ink in the vicinity of the heating elements 5 vaporizes to make a large number of small bubbles 12;

(b) Second, the small bubbles 12 merge together and grow into a larger bubble 13 that overcomes the surface tension, causing ink swells to be produced at the slits 2;

(c) Third, when the heating elements 5, on completion of heating, are cooled down to stop the bubble 13 from being produced, the swelling of ink is intercepted to produce ink droplets 14; and (d) Finally, the ink droplets 14 are jetted out through the slits 2 by the power of growing bubble 13.

If a number of heating elements 5 share the slits 2 and the ink chamber 11 with one another as in the above conventional apparatus, there arises a problem that the ink droplets 14 derived from adjoining heating elements 5 may interfere with each other. In the conventional apparatus, however, the fluid resistance elements 8 provided between adjoining heating elements 5, 5, as shown in FIG. 10, will serve to prevent pressure waves from being horizontally propagated while the bubbles are being produced, thereby allowing the ink droplets 14 to be formed and jetted out without being adversely affected by such pressure waves. Furthermore, the auxiliary holes 3 provided to the slit plate 1 will absorb the pressure waves, so that pressure waves may be prevented also from being reflected.

In the conventional apparatus arranged as described above, however, even if no problems occur during the recording operation thereof, the apparatus may have some problems if left out of recording operation in a long period, such as dried and solidified ink at some slits 2 or dust aggression from outside, which is likely to cause some recording failure or head damage.

SUMMARY OF THE INVENTION

The present invention has been accomplished to effectively solve the above-described technical problems and, accordingly, an essential object of the present invention is to provide an ink recording apparatus which can prevent ink from drying and also can prevent external contaminations of dust and, even when left unused for a long time period, and which is free of any recording failure or head damage.

Another important object of the present invention is to provide an ink recording apparatus which is internally protected from any touch of an operator's hands or fingers, thereby being highly reliable in its performance.

In accomplishing these and other objects, according to one preferred embodiment of the present invention, there are provided an ink chamber for being filled with ink, an ink jet port provided in the ink chamber, a shutter formed of a thin film and provided in the vicinity of the ink jet port and movable between a shut-off position for shutting off the ink passing through the ink jet port and a passing position for allowing the ink to pass therethrough, and shutter driving means for not only driving the shutter but also holding the shutter in the shut-off position while the apparatus is out of recording operation, the shutter driving means having electrodes provided in correspondence to each of the shut-off position and passing position for the shutter, a power supply for applying voltage to the electrodes, and a control circuit, whereby the shutter is driven by virtue of electrostatic attracting force acting between the surfaces of the electrodes and the surface of said shutter.

With the above-mentioned arrangement of the first embodiment of the ink recording apparatus according to the invention, the shutter disposed in the vicinity of the ink jet port is held in the shut-off position while the apparatus is out of recording operation. Thus the shutter can prevent ink from drying and also avoid contamination by any foreign matter from outside the apparatus and, even if the apparatus is left unused for a long period, keeping it free of any recording failure or head damage.

According to another preferred embodiment of the present invention, there are provided an ink chamber for being filled with ink, an ink jet port provided in the ink chamber, a shutter formed of a thin film and provided outside of the ink chamber and also in the vicinity of the ink jet port and movable between a shut-off position for shutting off the ink passing through the ink jet port and a passing position for allowing the ink to pass therethrough, shutter driving means for not only driving the shutter but also holding the shutter in the shut-off position while the apparatus is out of recording operation, the shutter driving means having electrodes provided in correspondence to each of the shut-off position and passing position for the shutter, a power supply for applying voltage to the electrodes, and a control circuit, whereby the shutter is driven by virtue of electrostatic attracting force acting between the surfaces of the electrodes and the surface of said shutter and a wall formed of a thin film and disposed outside of the shutter for covering the external surface of the shutter.

With the above-mentioned arrangement of the second embodiment of the ink recording apparatus according to the invention, the following operational effects can be obtained in addition to those of the ink recording apparatus of the first embodiment. That is, even if the shutter is subject to ink pressure in its shut-off position, the wall disposed on the rear side thereof supports the shutter to prevent the shutter from being deformed. The wall also prevents the internal structure of the apparatus including the shutter from being touched by hands, fingers, or other foreign matters from outside the apparatus, thus enhancing the reliability of the apparatus more than of the first embodiment of the invention.

BRIEF DESCRIPTION OF THE DRAWINGS

These and other objects and features for the present invention will become apparent from the following description taken in conjunction with the accompanying drawings, in which.

Figure 1:
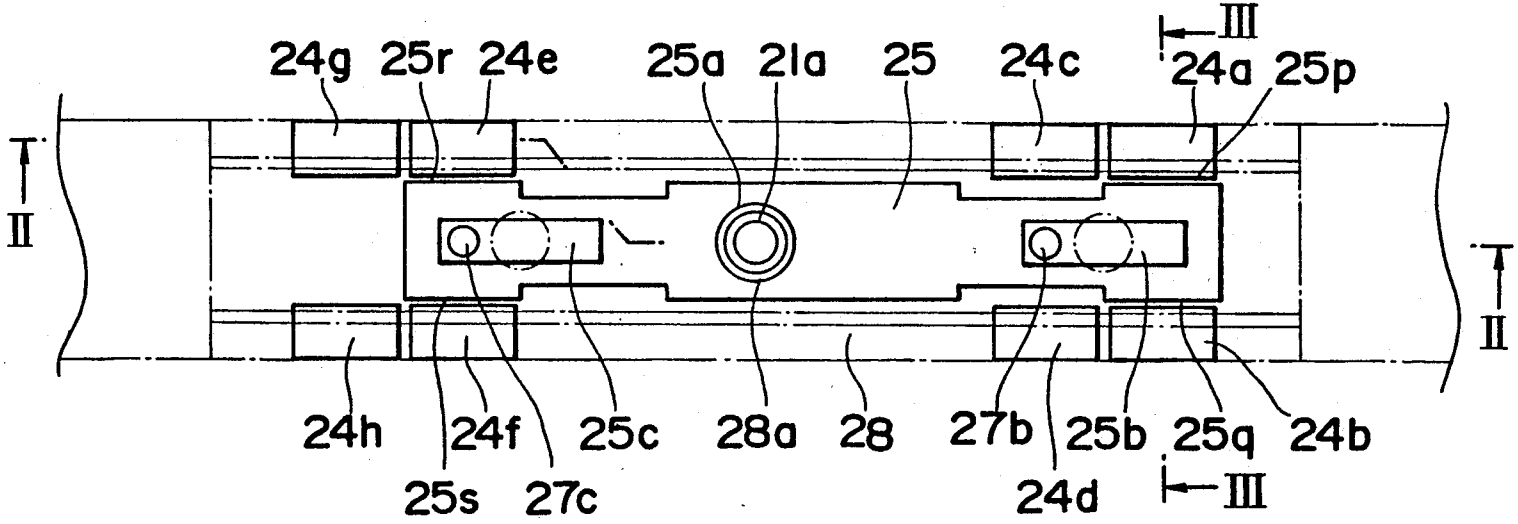
FIG. 1 is a plan view showing the construction of an ink recording apparatus of a first embodiment according to the present invention.
Figure 10:
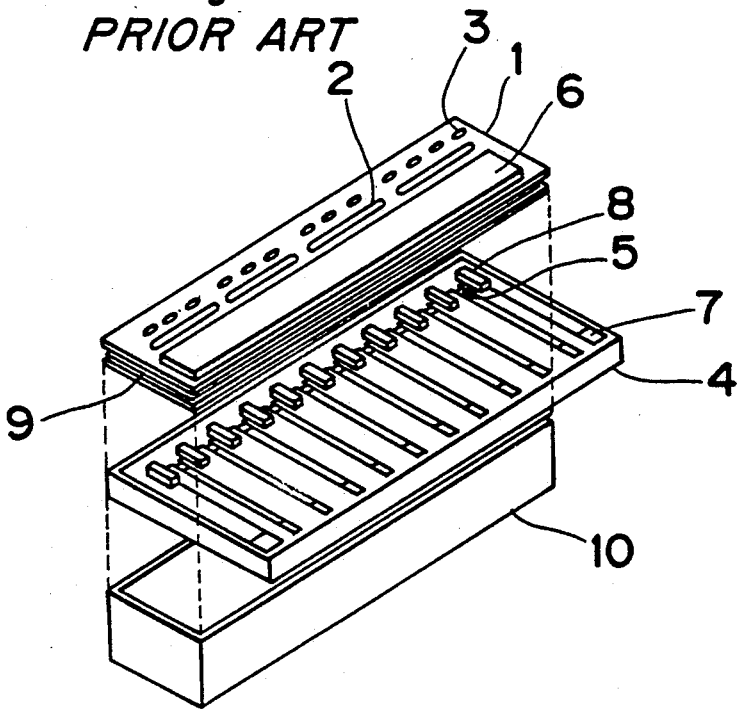
Fig. 10 PRIOR ART
Figure 8:
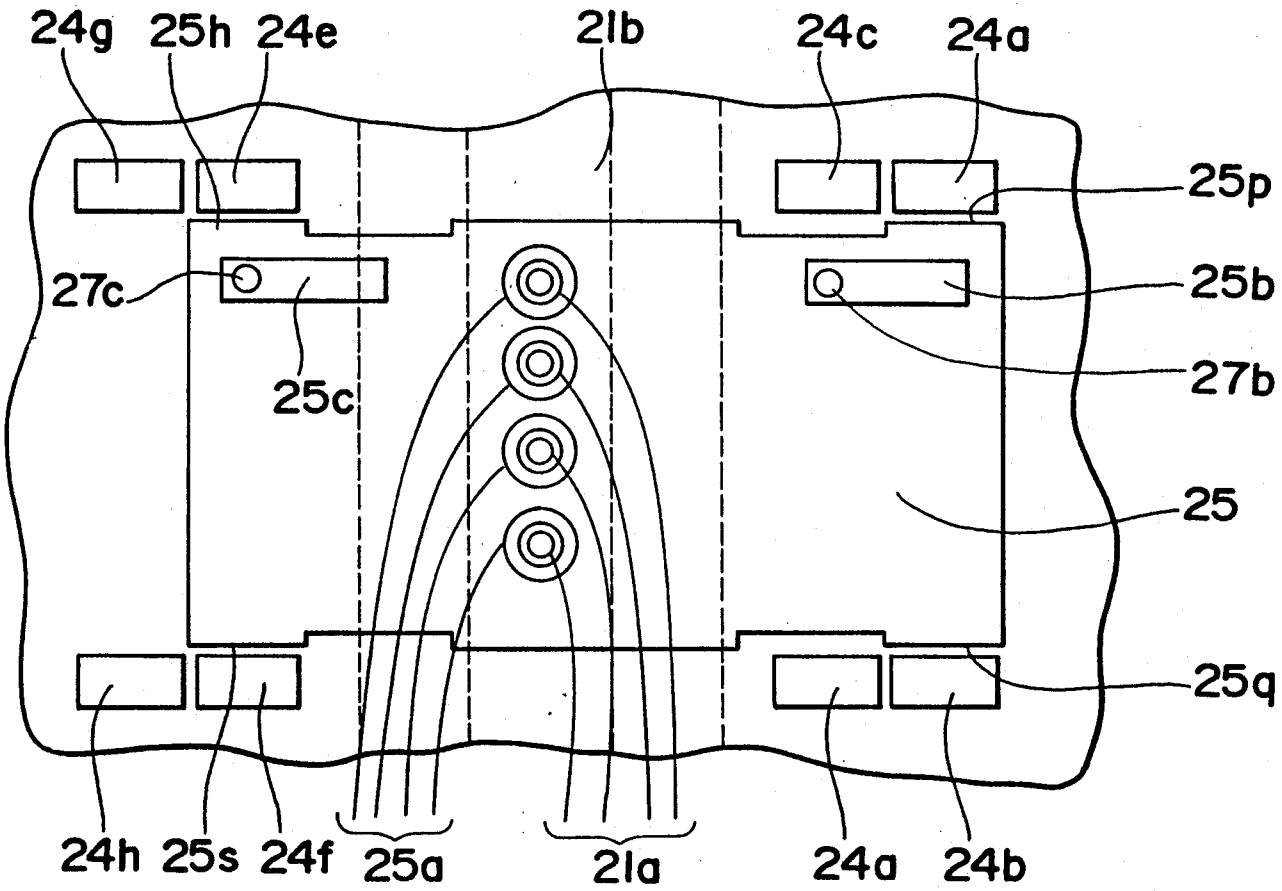
Figure 9:
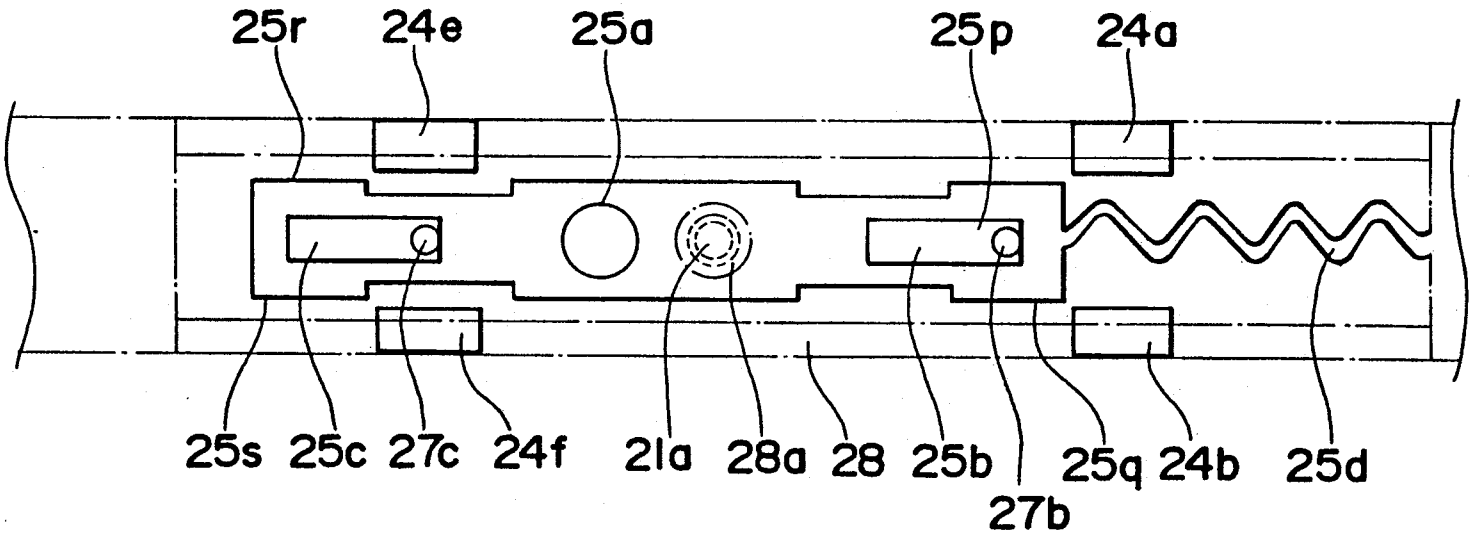
Figures 11A, 11B, 11C, 11D:
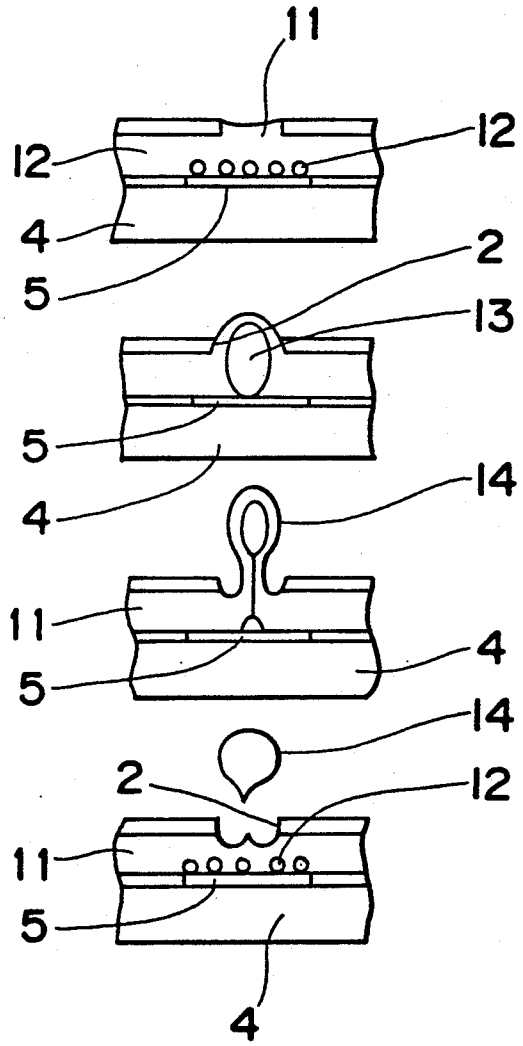
Fig.11a PRIOR ART
Fig.11b PRIOR ART
Fig.11c PRIOR ART
Fig.11d PRIOR ART

FIGS. *7a* to *7n* are views illustrating the manufacture processes of the ink recording apparatus of FIG. 1;

FIG. 8 is a plan view showing the construction of a second embodiment of the present invention;

FIG. 9 is a plan view showing the construction of an ink recording apparatus of a third embodiment of the invention;

FIG. 10 is a perspective view showing the construction of an ink recording apparatus according to the prior art; and FIGS. 11*a* to 11*d* are views illustrating the operation of the apparatus of FIG. 10.

DETAILED DESCRIPTION OF THE INVENTION

Before the description of the present invention proceeds, it is to be noted that like parts are designated by like reference numerals throughout the accompanying drawings.

Figure 2:
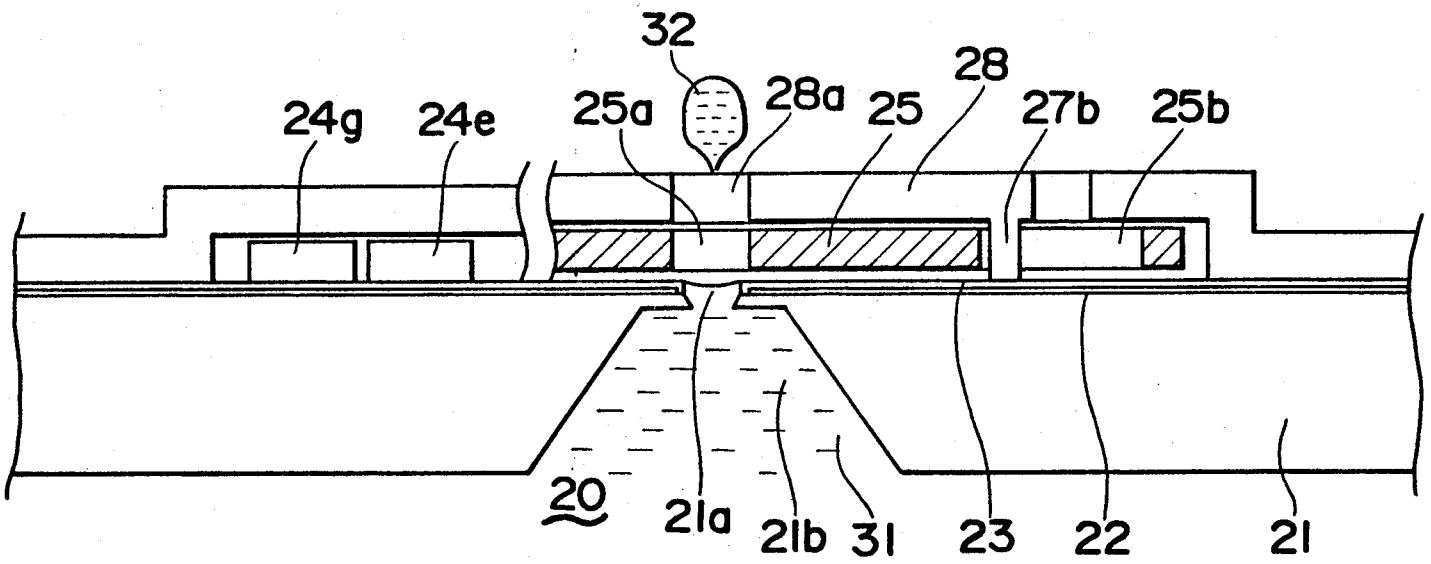
FIG. 2 is a sectional view taken along line II—II of FIG. 1.
Figure 3:
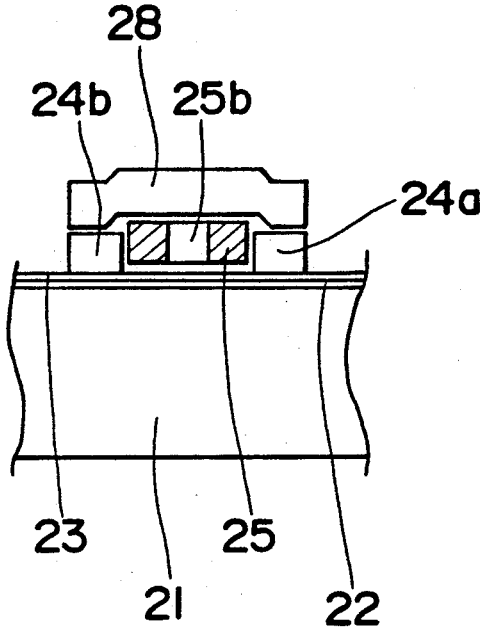
FIG. 3 is a sectional view taken along line III—III of FIG. 1.

Referring first to FIGS. 1 to 3, a single-crystal silicon substrate 21 has an ink jet port 21*a* provided in the center thereof and an ink sump 21*b* provided on its side adjoining an ink chamber 20. The ink jet port 21*a* is formed by being bored from the ink sump 21*b* through an oxide film 22 and a nitride film 23. Electrodes 24*a* to 24*h* formed of polycrystalline-silicon, the wiring of which is omitted in the figures, each have on their surfaces a nitride film 23 formed as an insulating layer (not shown). A shutter 25 formed of polycrystalline-silicon has an ink passing hole 25*a* provided in its center and guide slots 25*b*, 25*c* provided on opposite sides thereof. On the surfaces of the shutter 25 except the underside thereof there is formed nitride films (not shown) as lubricating layers. Guide pins 27*b*, 27*c* are formed also of polycrystalline-silicon. A front wall 28 illustrated by single dotted chain lines in FIG. 1, as integrated with the guide pins 27*b*, 27*c*, has an opening 28*a* provided in its center. On the other hand, the ink chamber 20 and the ink sump 21*b* are charged with ink 31 composed of insulating material. The ink 31 is subject to working pressures corresponding to recording signals through ordinary means such as a pressure device comprising a piezoelectric element or a heating element as shown in FIG. 10, which means is not shown.

The component parts shown in FIGS. 1 to 3, as detailed later, are integrally manufactured onto the substrate 21 using semiconductor device manufacturing processes including lithography and etching. The result is that the component parts are substantially compact in size, light in weight, and of high precision, being comparable to semiconductor products.

Figure 4:
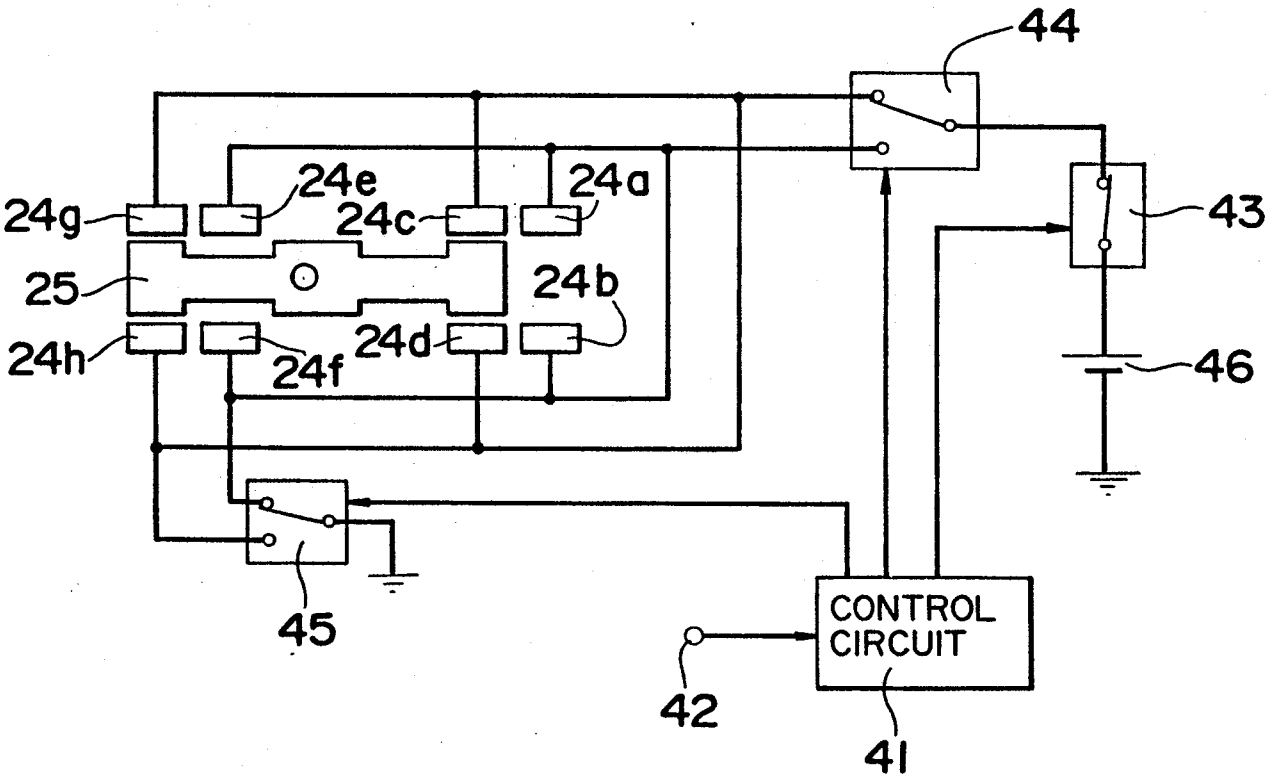
FIG. 4 is a block diagram showing a driving circuit of the ink recording apparatus of FIG. 1.

FIG. 4 is a block diagram showing a driving circuit for driving the ink recording apparatus. In the figure, a control circuit 41 receives a recording signal from the apparatus main body (not shown) via an input terminal 42, subsequently deciding the status of the signal to control switches 43 to 45. The switch 43 serves to turn on and off a power supply 46, while the switches 44 and 45 serve to control one group of connected electrodes 24*a*, 24*b*, 24*e*, and 24*f* and the other group of like electrodes 24*c*, 24*d*, 24*g*, and 24*h*, respectively, so as to render the two groups of electrodes oppositely phased. More specifically, while a voltage is applied to the side of the electrodes 24*a*, 24*b*, 24*e*, and 24*f*, the electrodes 24*c*, 24*d*, 24*g*, and 24*h* are grounded; and vice versa.

Now the ink recording apparatus arranged as stated above will be explained with respect to its operation. The state thereof shown in FIGS. 1 to 3 is such that the control circuit 41 judges the apparatus to be in recording operation according to an input signal delivered from the apparatus main body via the input terminal 42, turning on the switch 43 and activating the switches 44, 45, with the result that a voltage of several times 10 V or so is applied to the side of the electrodes 24*a*, 24*b*, 24*e*, and 24*f*. In this state, the shutter 25 is stably positioned as shown in the figures with its ends 25*p*, 25*q*, 25*r*, and 25*s* sucked up by virtue of electrostatic attracting force acting between the ends and the surfaces of the electrodes 24*a*, 24*b*, 24*e*, and 24*f*, where the ink passing hole 25*a* of the shutter 25 is aligned with the ink jet port 21*a* provided to the substrate 21. Then, due to the pressure within the ink chamber 20, the ink 31 charged in the ink sump 21*b* passes through the ink jet port 21*a* and ink passing hole 25*a* and further through the opening 28*a* of the front wall 28, thus making ink droplets 32 to be jetted out.

At this point of the state of the apparatus, setting recording paper at the outside of the front wall 28 allows the ink droplets 32 to record any patterns of characters, symbols, and the like. Moreover, the front wall 28 surrounding the shutter 25 for coverage serves to protect an operator's hands or fingers or prevent other foreign matters from touching the shutter from outside, thereby preventing the internal structure including the shutter 25 from being damaged resulting in high reliability thereof.

Succeedingly to the above-described state, even if the control circuit 41 turns off the switch 43 to de-energize the electrodes 24*a*, 24*b*, 24*e*, and 24*f*, the shutter 25 will remain stable at rest position thereof primarily by virtue of surface force.

Figure 5:
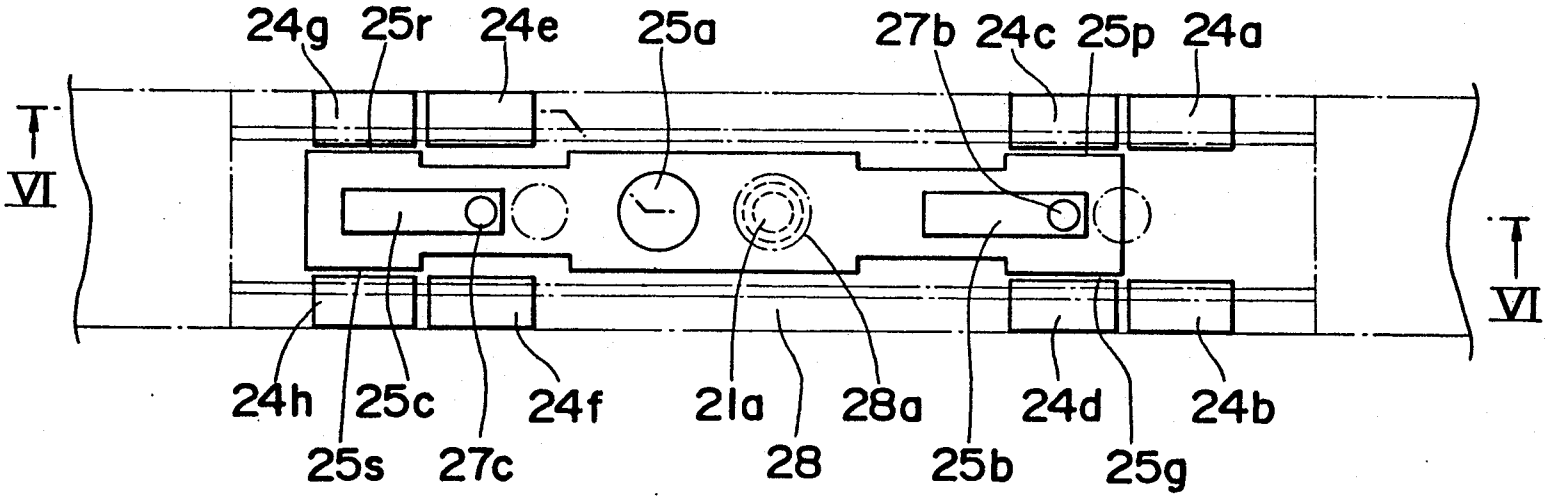
FIG. 5 is a view illustrating the operation of the ink recording apparatus of FIG. 1.
Figure 6:
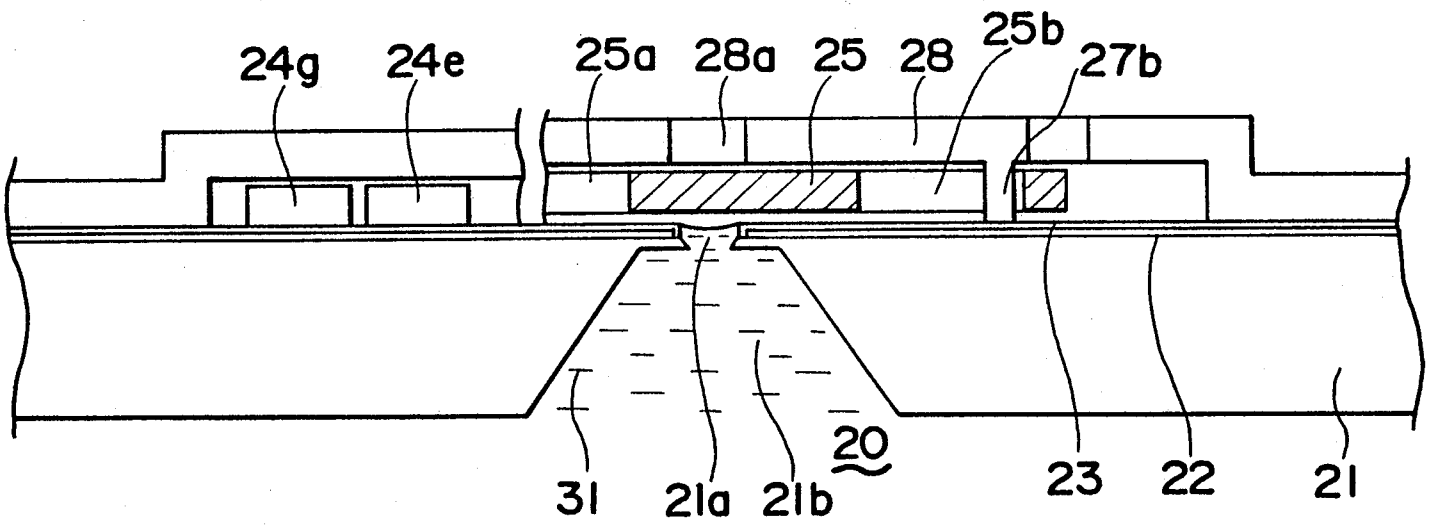
FIG. 6 is a sectional view taken along line VI—VI of FIG. 5.

Next, with reference to FIGS. 5 and 6, the ink recording apparatus will be described in its states in which the shutter 25 has moved away from the position shown in FIG. 1. In this case, the control circuit 41 judges when the apparatus has completed the recording operation according to an input signal delivered from the apparatus main body via the input terminal 42, changing the condition of the switches 44, 45, with a result that a voltage is applied to the side of the electrodes 24*c*, 24*d*, 24*g*, and 24*h*. In this case, as shown in FIG. 5, the shutter 25 is stably positioned at rest having moved from the position shown in FIG. 1 with its ends 25*p*, 25*q*, 25*r*, and 25*s* sucked up by virtue of electrostatic attracting force acting between the ends and the surfaces of the electrodes 24*c*, 24*d*, 24*g*, and 24*h*, where the ink jet port 21*a* is shut off by the shutter 25, thus effectively preventing the ink from drying and solidifying and further avoiding contaminations by any foreign matter from outside.

In this state of the apparatus, even if the ink 31 charged in the ink sump 21*b* is jetted out through the ink jet port 21*a* due to any externally induced pressure applied within the ink chamber 20, the shutter 25 will shut off the passage of the ink flow from the outside of the shutter, thus minimizing the possibility that some careless mishandling, accident, or other troubles may cause external stains due to the ink. Moreover, even if any pressure is applied within the ink chamber 20, where the shutter 25 is subject to an ink jet pressure, the shutter 25 is supported by being pressed against the front wall 28, thus being free of any distortion and therefore ensuring the substantially high reliability thereof.

In such a state of the apparatus, even if the control circuit 41 turns off the switch 43 to suspend the continuity to the side of electrodes 24*c*, 24*d*, 24*g*, and 24*h*, the shutter 25 will remain stably positioned at rest by virtue of surface force. The apparatus therefore, even if left unused for a long period, can prevent any recording failure or any head damage. Moreover, the front wall 28 surrounding the shutter 25 for coverage serves to protect against the operator's hands or fingers or other foreign matters from touching the shutter from outside, thereby preventing shutter 25 from being moved therewith.

As described heretofore, according to the present invention, it is possible to provide an ink recording apparatus which can prevent ink drying and also avoided contaminations, which is free of any recording failure or head damage even if left unused for a long period, and which can be highly reliable and protected against the interior being touched by an operator's hands or fingers or other foreign matters.

Next, with reference to FIGS. 7*a* to 7*n*, the manufacturing method of the ink recording apparatus of the above-mentioned embodiments will be described, wherein, since the method utilizes the one generally used in semiconductor device manufacturing techniques, the description of individual processes will be simplified by omitting the details thereof which are common knowledge.

Figure 7A:
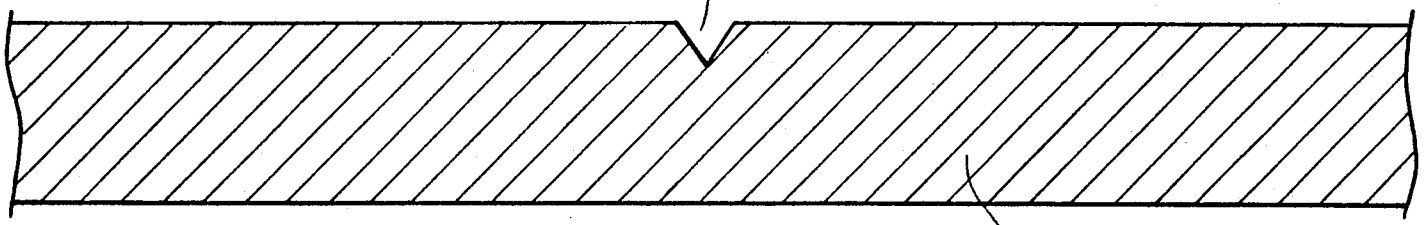

(a) A concave portion 21*a'* as illustrated in FIG. 7*a* is formed on the surface of the single-crystal silicon substrate 21 by anisotropic etching. As the etching solution, an aqueous solution of potassium hydroxide (KOH) is used. Photoresist is removed by photo-resist stripping using oxygen plasma. The removing of photoresist is carried out likewise in the following processes.

Figure 7B:
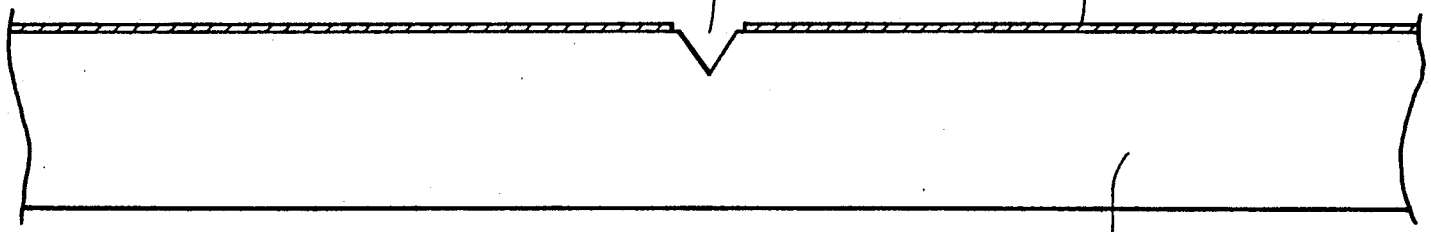
Figure 7C:
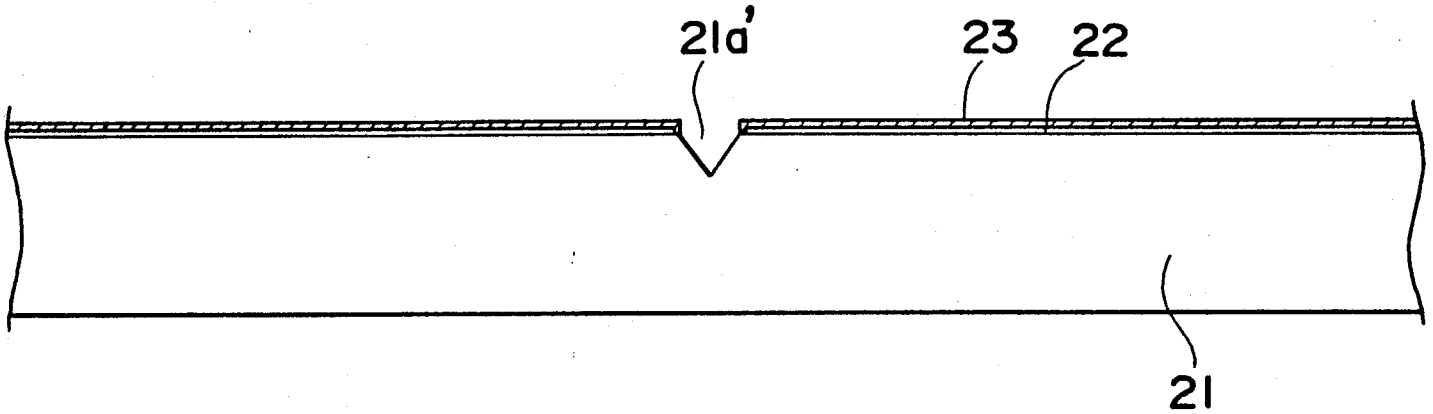
Figure 7D:
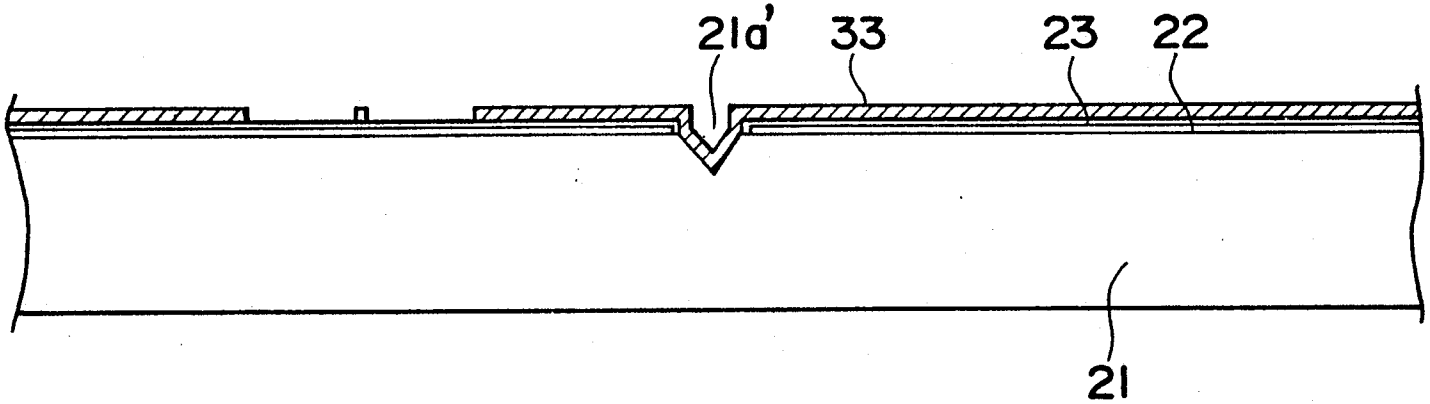
Figure 7E:
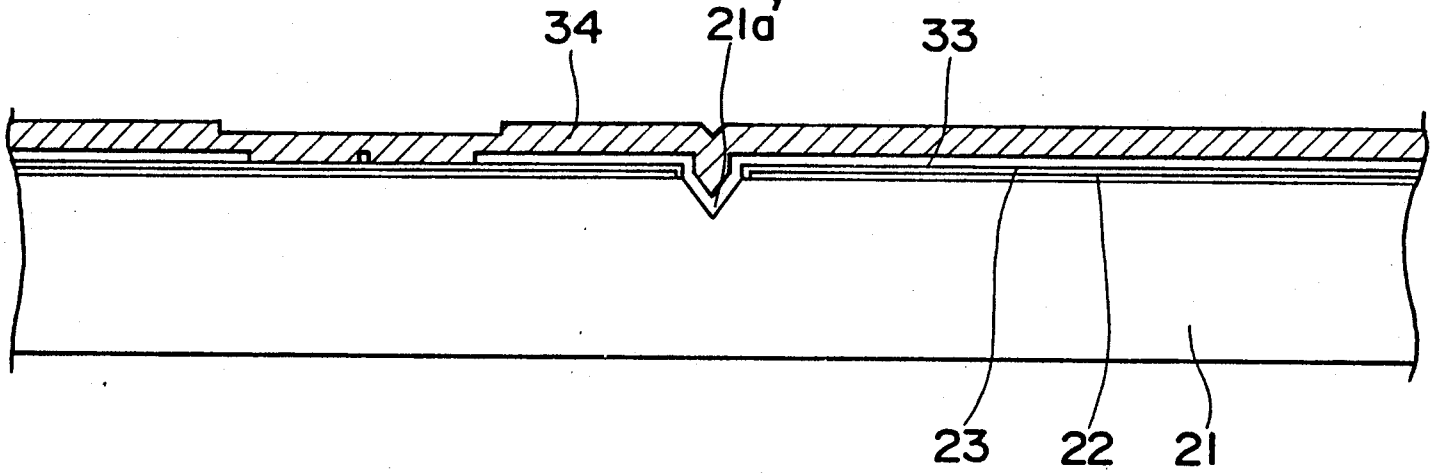
Figure 7F:
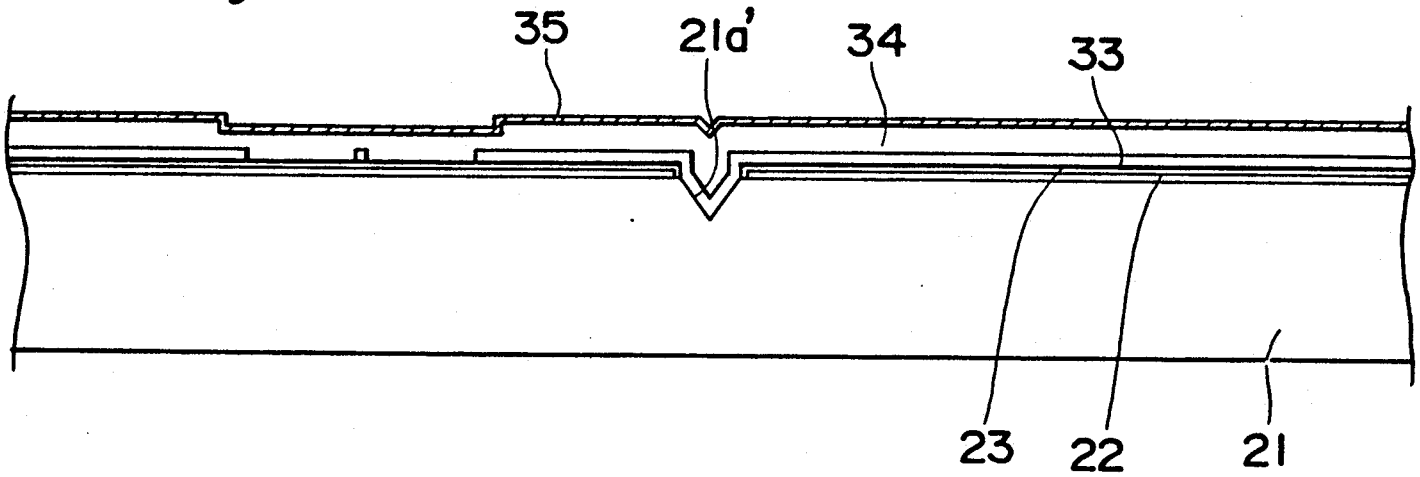

(b) The oxide film 22 ($SiO_2$) is to grow on the substrate 21, where the oxide film 22 is made grown by depositing a PSG (Phosphor Silicate Glass) layer 33 of a weight ratio of 8% by the method of LPCVD (Low Pressure Chemical Vapor Deposition) at a temperature of approximately 450° C., and the film 22 is etched using a buffered hydrofluoric acid, as shown in FIG. 7*b*.

(c) The nitride film 23 ($Si_3N_4$) is deposited on the oxide film 22, subjected to patterning by RIE (reactive-ion-etching). The nitride film 23 in combination with the oxide film 22 makes up an insulating layer, the dielectric breakdown voltage of which is more than 500 V. The nitride film 23 also serves to protect the oxide film 22 dissolved with the buffered hydrofluoric acid.

(d) A PSG layer 33 of a weight ratio of 8% is deposited by the LPCVD method at approximately 450° C., followed by etching using the buffered hydrofluoric acid.

(e) A polycrystalline-silicon layer 34 is entirely deposited at approximately 610° to 630° C. by the LPCVD method and shaped as shown in the figures by plasma etching. The polycrystalline-silicon layer 34 forms the electrodes 24*a* to 24*h* and the shutter 25. Then, annealing is performed to remove the residual stress. In addition, the polycrystalline-silicon layer 34 may be imparted with electrical conductivity by diffusing phosphorus thereinto as required.

(f) An oxide film 35 is made to grow on the polycrystalline-silicon layer 34, where for the oxide film 35 a PSG layer of a weight ratio of 8% may be deposited at approximately 450° C. by the LPCVD method. The oxide film 35 will serve as a protection film for the RIE later formed.

Figure 7G:
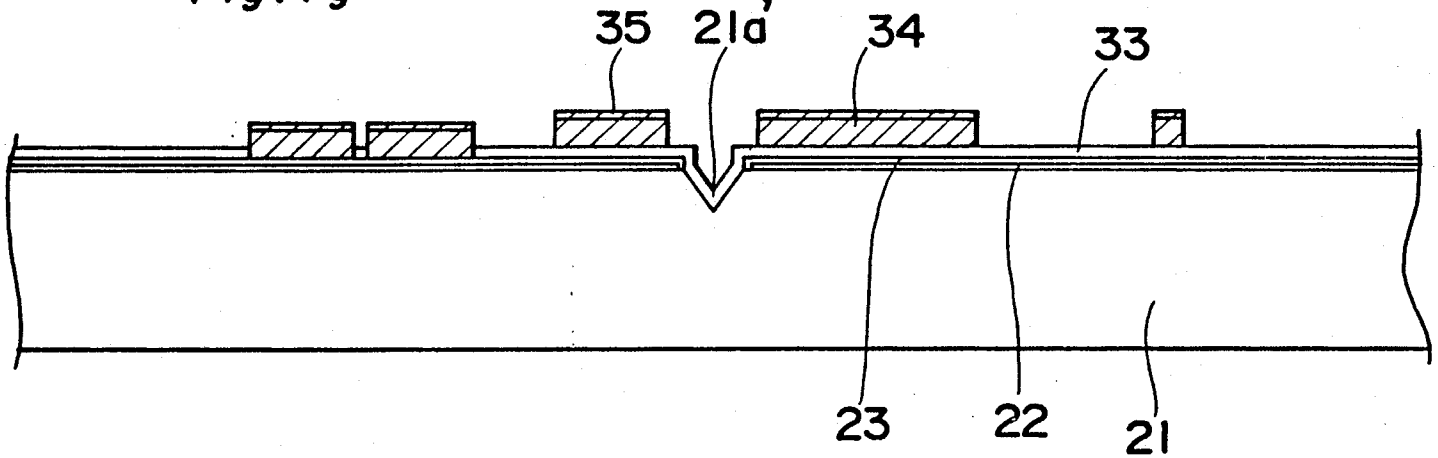

(g) The polycrystalline-silicon layer 34 and the oxide film 35 are subjected to patterning by plasma etching as shown in FIG. 7*g*, thereby being shaped into the electrodes 24*a* to 24*h* and the shutter 25. In this process, end point is detected with 30% overetching, and annealing are performed to remove the residual stress.

Figure 7H:
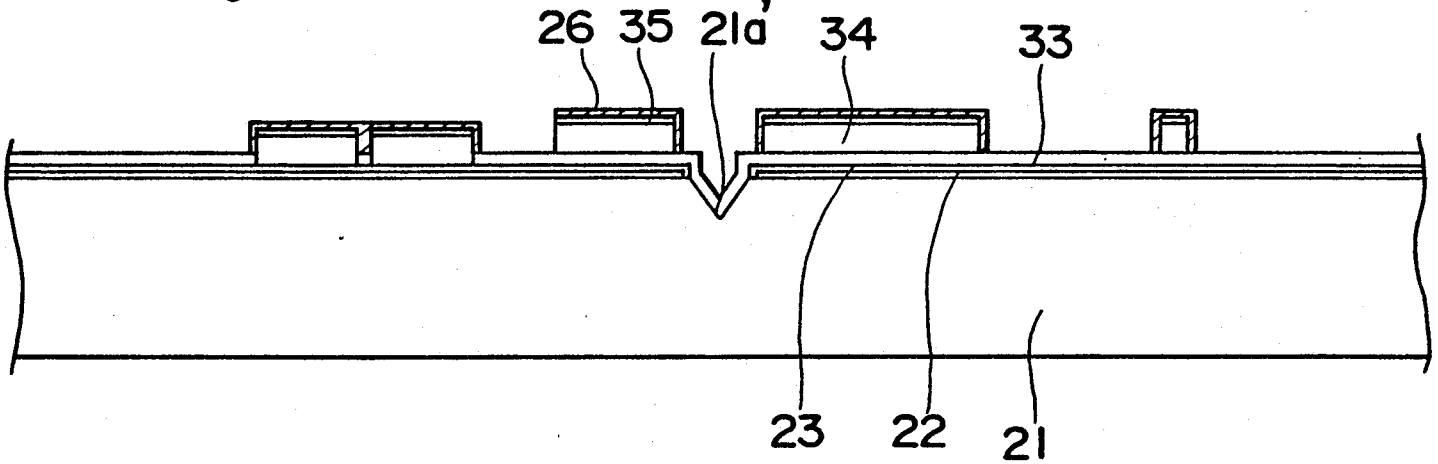
Figure 7I:
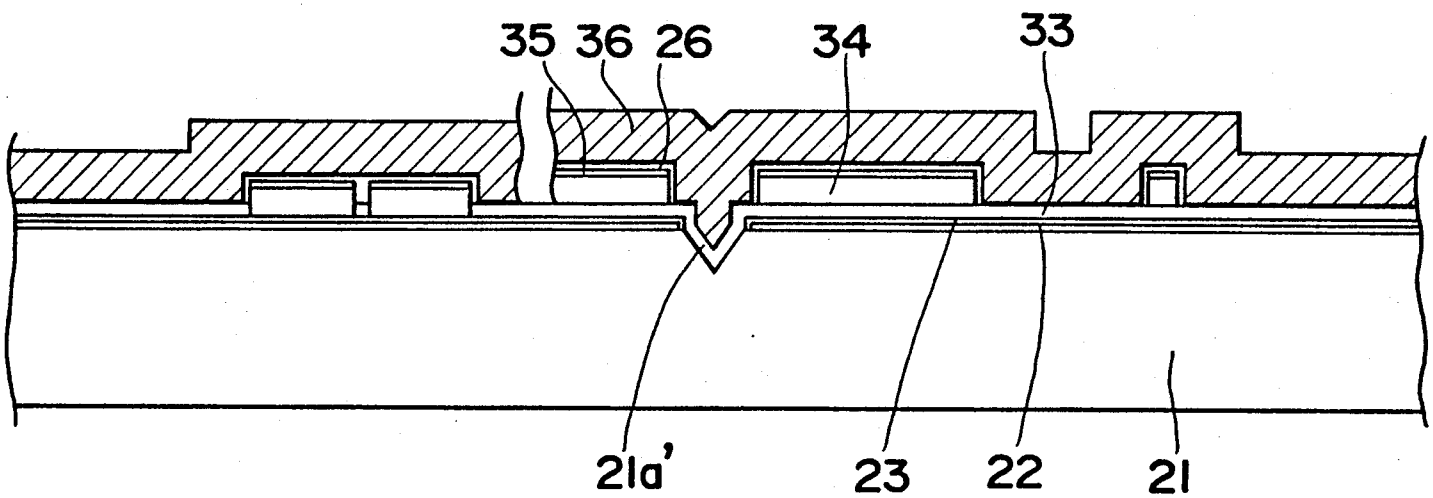

(h) A nitride ($Si_3N_4$) film 26 is deposited as shown in FIG. 7*h*, where patterning is performed by the RIE. The nitride film 26 finally forms the above-mentioned nitride film (not shown), serving as a lubricating layer for reducing the friction between the shutter 25 and relevant portions and compensating for the brittleness of materials and also as an insulating layer (not shown) for the electrodes 24*a* to 24*h*.

(i) A PSG layer 36 of a weight ratio of 8% is entirely deposited by the LPCVD method at approximately 450° C.

Figure 7J:
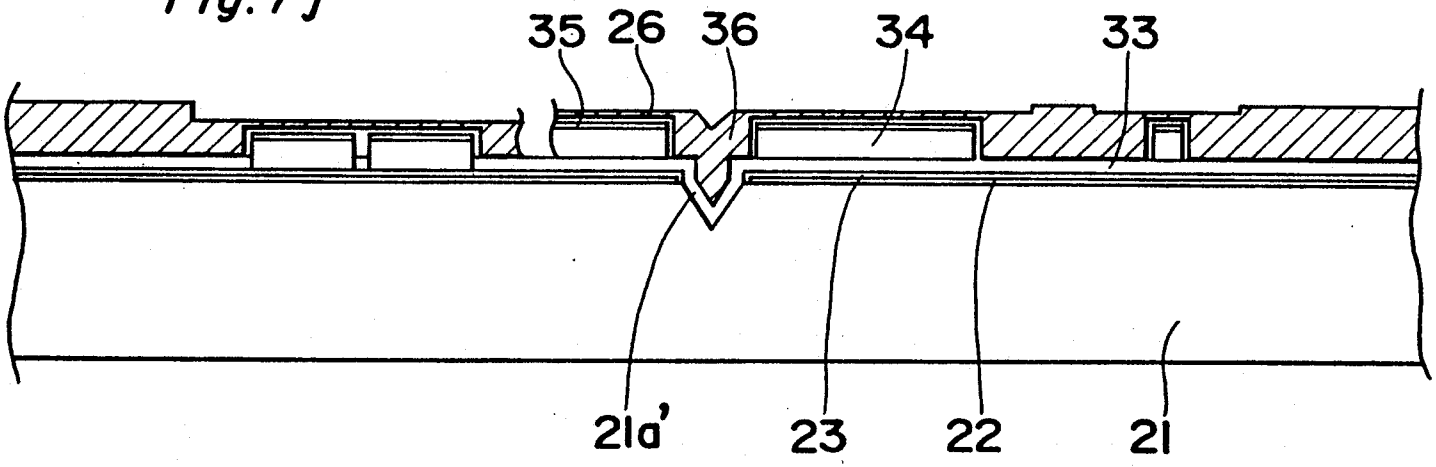

(j) The PSG layer 36 is etched using buffered hydrofluoric acid as shown in FIG. 7*j*.

Figure 7K:
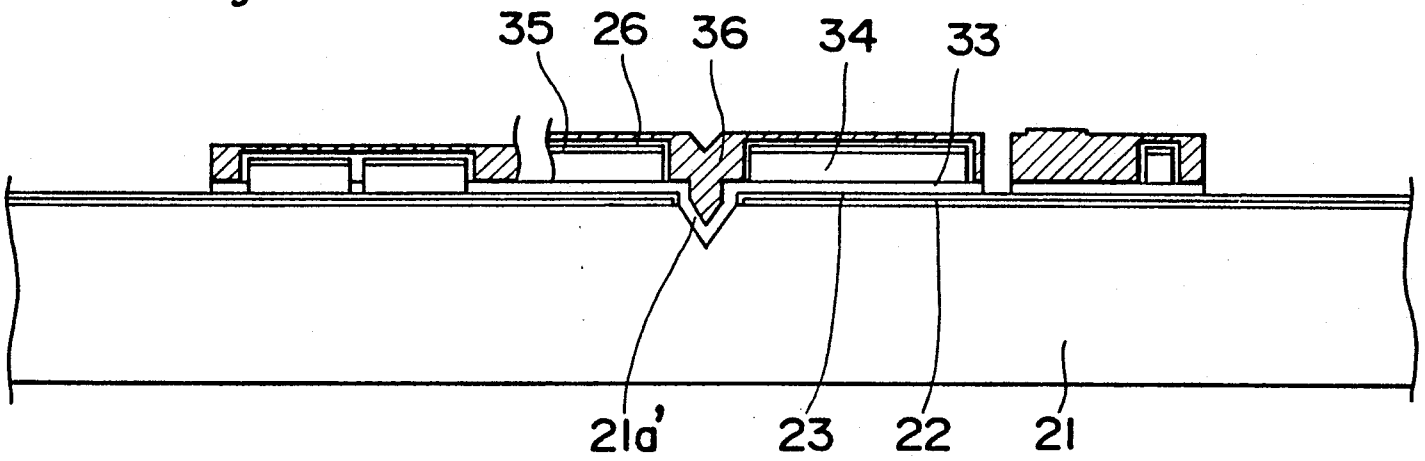

(k) The PSG layer 36 is subjected to patterning by plasma etching as shown in FIG. 7*k*. This patterning will enable the fixing of the guide pins 27*b*, 27*c* and the front wall 28 (both shown in FIG. 1) to be later formed. The end points are detected with 30% overetching.

Figure 7L:
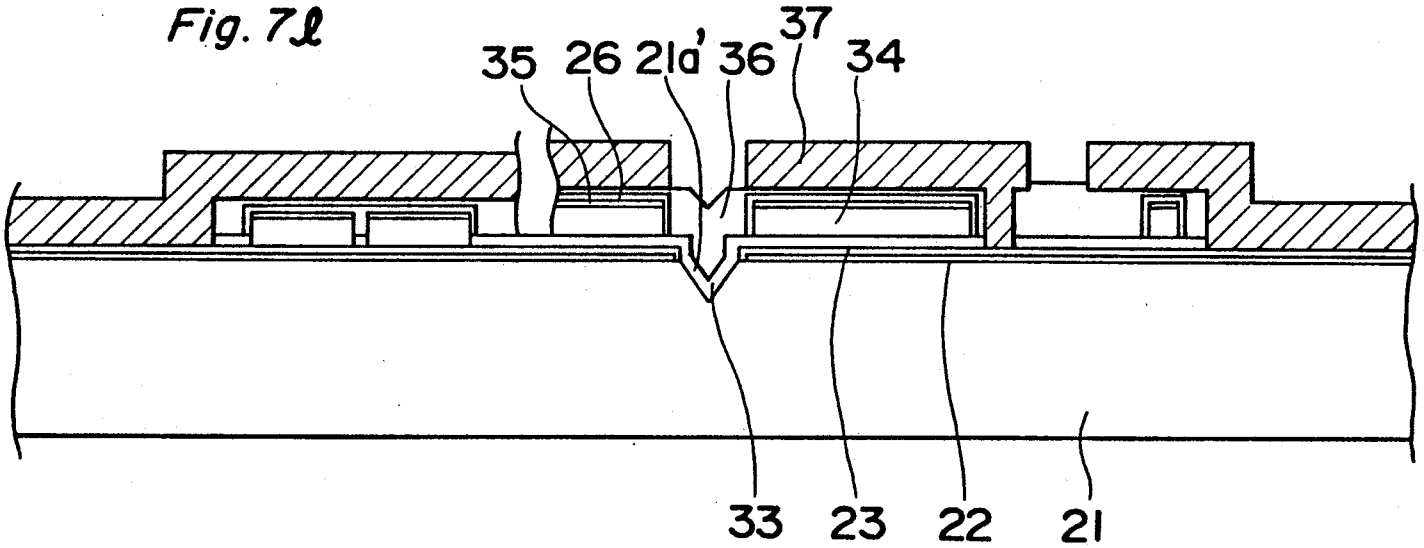
Figure 7M:
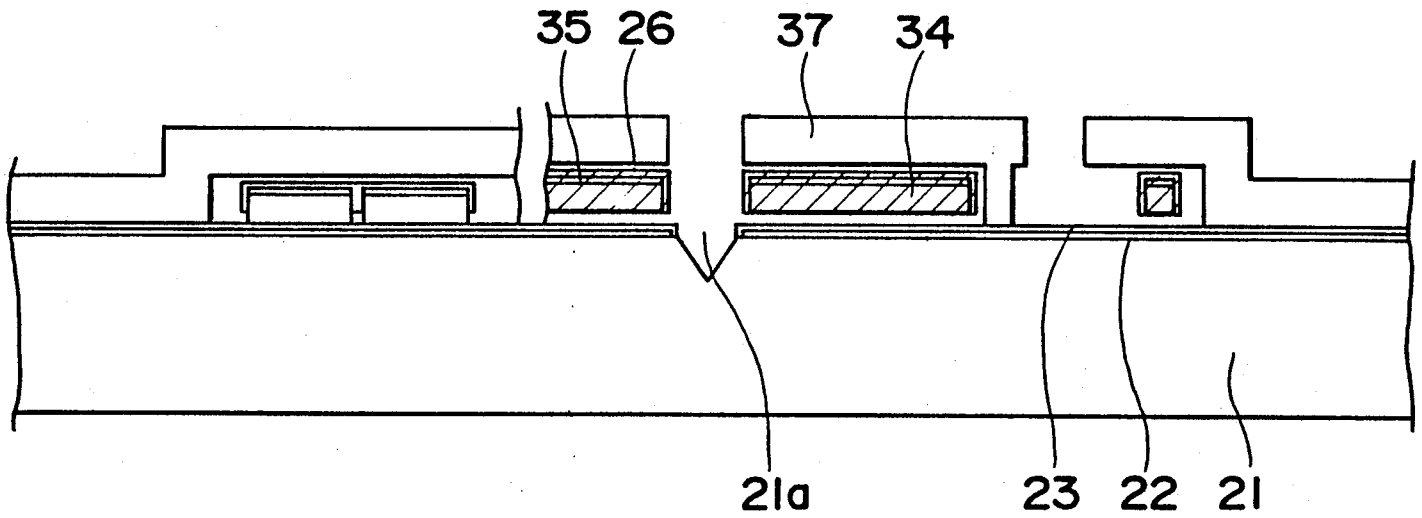
Figure 7N:
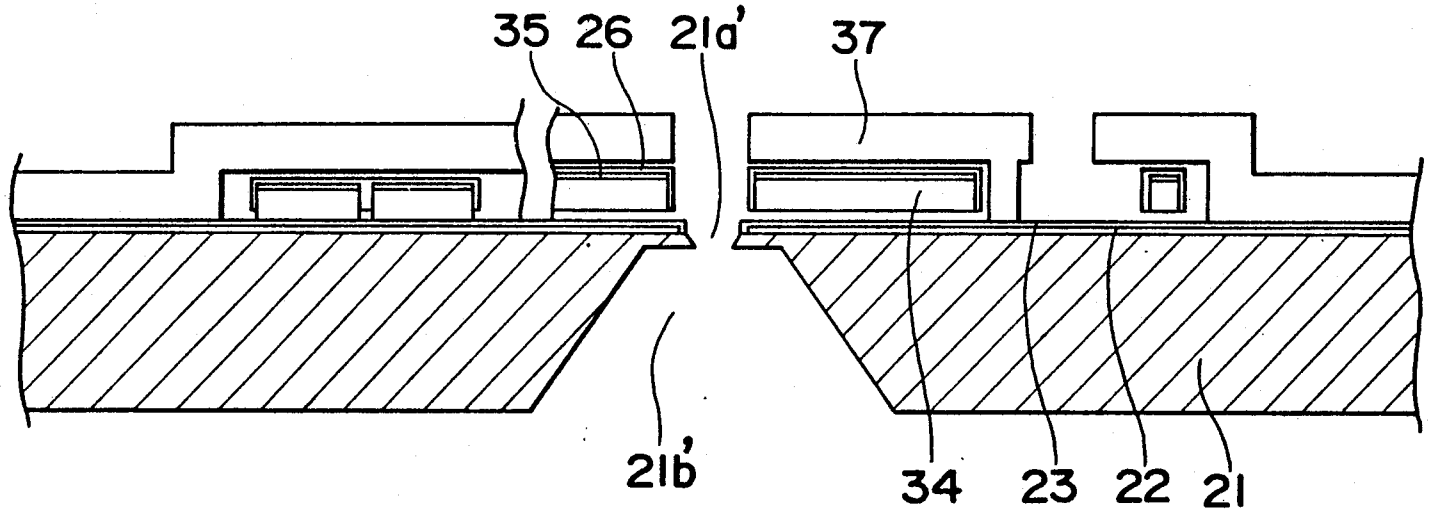

(l) a polycrystalline-silicon layer 37 is deposited by the LPCVD method at approximately 610° to 630° C., subjected to patterning by plasma etching as shown in FIG. 7l, thus forming the guide pins 27*b*, 27*c* and the front wall 28. Here, annealing is performed to remove the residual stress.

(m) The PSG layers (or oxide films) 33, 36 are dissolved with a buffered hydrofluoric acid to form a movable member into which the polycrystalline-silicon layer 34 and the oxide film 35 are integrated, thereby forming the shutter 25 as shown in FIG. 1.

(n) The substrate 21 is anisotropically etched from its rear side as shown in FIG. *7n* to form the concave portion 21*b'* until it is bored through up to the concave portion 21*a*, first formed. This allows the ink jet port 21*a* and the ink sump 21*b*, as shown in FIG. 2, to be formed.

Through the above processes, the ink recording apparatus of the first embodiment of the present invention can be manufactured. As seen here, the component structures are integrally manufactured using semiconductor device manufacturing processes, thereby allowing the structures to be integrated very simply and furthermore rendering them high in precision as well as steady in performance. Besides, the whole apparatus is so thin that it may be arranged in the clearance between recording paper and the head. Accordingly, the ink recording apparatus can be steadily mass-produced yet have remarkably high reliability, light weight and compactness, and further high precision.

In addition, although in the foregoing first embodiment of the invention the front wall 28 is formed of the same material and constructed in the same manner as those in the shutter 25 and the like, a front wall produced by any other manufacturing method may be combined therewith.

Moreover, although in the first embodiment of the invention one ink jet port 21*a* and one shutter 25 are combined with the ink jet port 21*a*, a plurality of ink jet ports 21*a* may also be provided for the combination with the ink chamber 20 as a second embodiment, as shown in FIG. 8. In FIG. 8, the front wall 28 is not illustrated and the ink sump 21*b* is indicated by broken lines. The ink recording apparatus of the second embodiment of the present invention can also be manufactured by the same manufacturing method as described above.

The third embodiment of the invention can be arranged as shown in FIG. 9, wherein the shutter 25 may be integrally provided with an elastic member 25*d* to produce a resilient force against the front wall 28, thereby holding its state mechanically. In this case, although it is impossible to cut off the feed to the electrodes 24*a*, 24*b*, 24*e*, and 24*f* while the recording is enabled as stated above, the shutter 25 may in turn be blocked by interrupting the feed to the electrodes, thereby allowing the electrodes to be reduced in number so that the shutter can be held blocked more steadily than in the first embodiment, with a result of further enhanced reliability. As a matter of course, the ink recording apparatus of the third embodiment can also be manufactured by the foregoing method.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. An ink recording apparatus comprising:

an ink chamber for being filled with ink;

an ink jet port provided in said ink chamber;

a shutter formed of a thin film and being provided in a vicinity of said ink jet port, said shutter being movable between a shut-off position for shutting off ink from passing through said ink jet port and a passing position for allowing ink to pass through said ink jet port; and shutter driving means for not only driving said shutter but also holding said shutter in said shut-off position while the apparatus is out of recording operation, said shutter driving means having electrodes provided in correspondence to each of said shut-off position and said passing position for said shutter, a power supply for applying voltage to said electrodes, and a control circuit, whereby said shutter is driven by virtue of electrostatic attracting force action between the surfaces of said electrodes and the surface of said shutter.

2. An ink recording apparatus comprising:

an ink chamber for being filled with ink;

an ink jet port provided in said ink chamber;

a shutter formed of a thin film and provided in a vicinity of said ink jet port and outside of said ink chamber, said shutter being movable between a shut-off position for shutting off ink from passing through said ink jet port and a passing position for allowing ink to pass through said ink jet port;

shutter driving means for not only driving said shutter but also holding said shutter in said shut-off position while the apparatus is out of recording operation, said shutter driving means having electrodes provided in correspondence to each of said shut-off position and said passing position for said shutter, a power supply for applying voltage to said electrodes, and a control circuit, whereby said shutter is driven by virtue of electrostatic attracting force action between the surfaces of said electrodes and the surface of said shutter; and a wall formed of a thin film and provided outside of said shutter for covering the external surface of said shutter.

3. An ink recording apparatus as claimed in claim 1, wherein said shutter driving means includes an elastic member for biasing said shutter toward said shut-off position.

* * * * *